United States Patent [19]

Cheung

[11] 4,081,200

[45] Mar. 28, 1978

[54] METHOD AND APPARATUS TO REMOVE STRUCTURAL CONCRETE

[75] Inventor: John B. Cheung, Bellevue, Wash.

[73] Assignee: Flow Industries, Inc., Kent, Wash.

[21] Appl. No.: 749,215

[22] Filed: Dec. 10, 1976

[51] Int. Cl.[2] ..... E01C 23/09; E21C 37/06

[52] U.S. Cl. ..... 299/17; 239/172; 241/1; 299/36

[58] Field of Search ..... 299/17, 36; 241/1, 30, 241/39; 404/90, 91; 239/172

[56] References Cited

U.S. PATENT DOCUMENTS

| | | | |
|---|---|---|---|
| 2,684,558 | 7/1954 | Harris et al. | 299/36 UX |
| 3,614,163 | 10/1971 | Anderson | 299/17 X |
| 3,778,109 | 12/1973 | Anderson et al. | 299/17 X |
| 3,792,907 | 2/1974 | Anderson | 299/17 |
| 3,796,463 | 3/1974 | Naydan et al. | 299/17 X |
| 3,857,516 | 12/1974 | Taylor | 299/17 X |
| 3,960,407 | 6/1976 | Noren | 299/17 |

*Primary Examiner*—Ernest R. Purser
*Attorney, Agent, or Firm*—Christensen, O'Connor, Johnson & Kindness

[57] ABSTRACT

By the action of water jetted against the concrete in systematically controlled manner under ultra-high pressures (i.e. above 25,000 psi) areas of structural concrete are removed to required depths through the one or more levels of aggregate involved efficiently and with safety to the basic structure and to attendant personnel. With this method and apparatus employing an array of such jets scanned progressively back and forth over a work area, the rates at which requisite volumes of hardened concrete can be removed, regardless of condition or state of the concrete and the presence of reinforcing bars, are much greater than those customarily achieved with conventional methods. Moreover the operation can be performed without danger of cutting into and weakening embedded reinforcing bars, without damaging the concrete in adjoining regions, without dust pollution and with minimum noise levels that are also readily shieldable. The sequential penetrating and exploding action of the ultra-high pressure water entering between and beneath the aggregate particles not only removes the concrete immediately surrounding embedded reinforcing bars but is also effective to remove surface scale and corrosion from such bars, conditioning them to form a strong bond with fresh concrete to be poured around them. Moreover, incidence angle of the water jets to the concrete surface may be varied during scan so as to enhance the removal action in places otherwise difficult to reach, such as beneath and behind reinforcing bars or composites of such bars.

17 Claims, 9 Drawing Figures

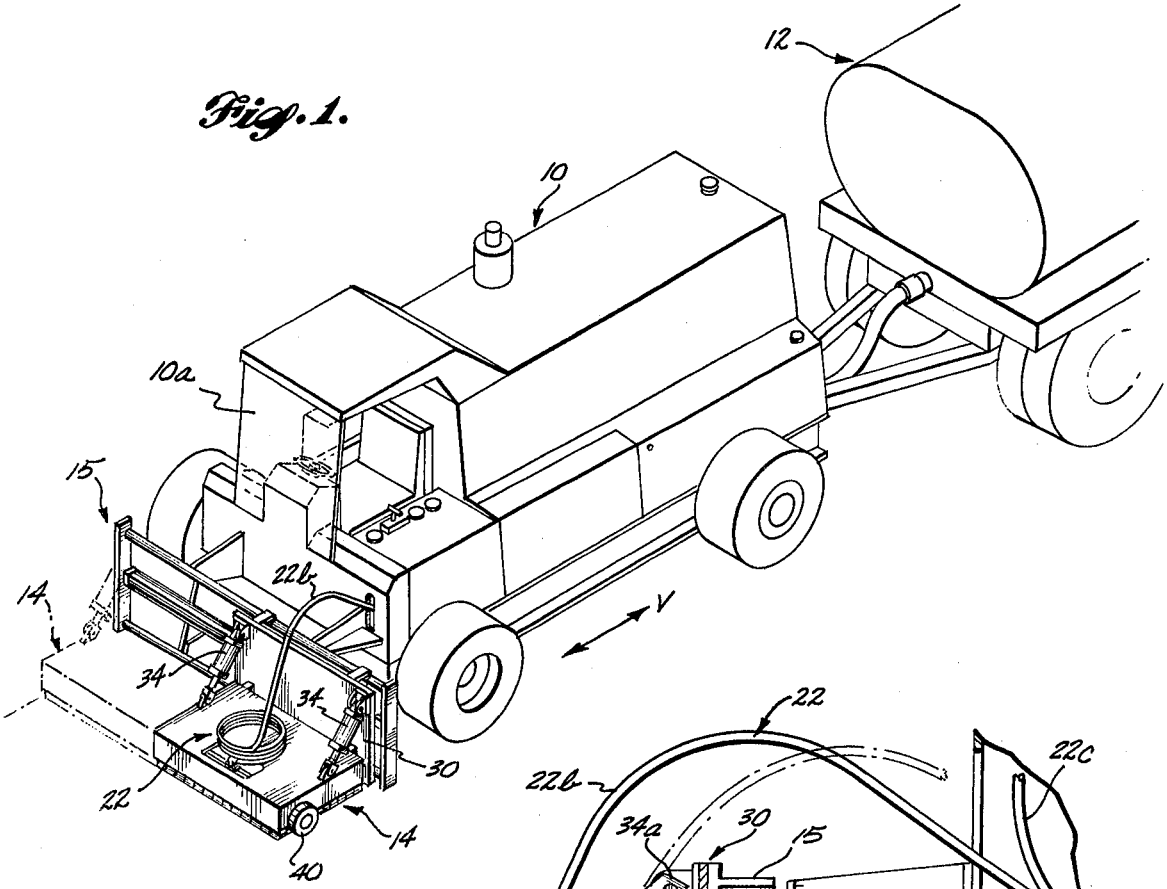
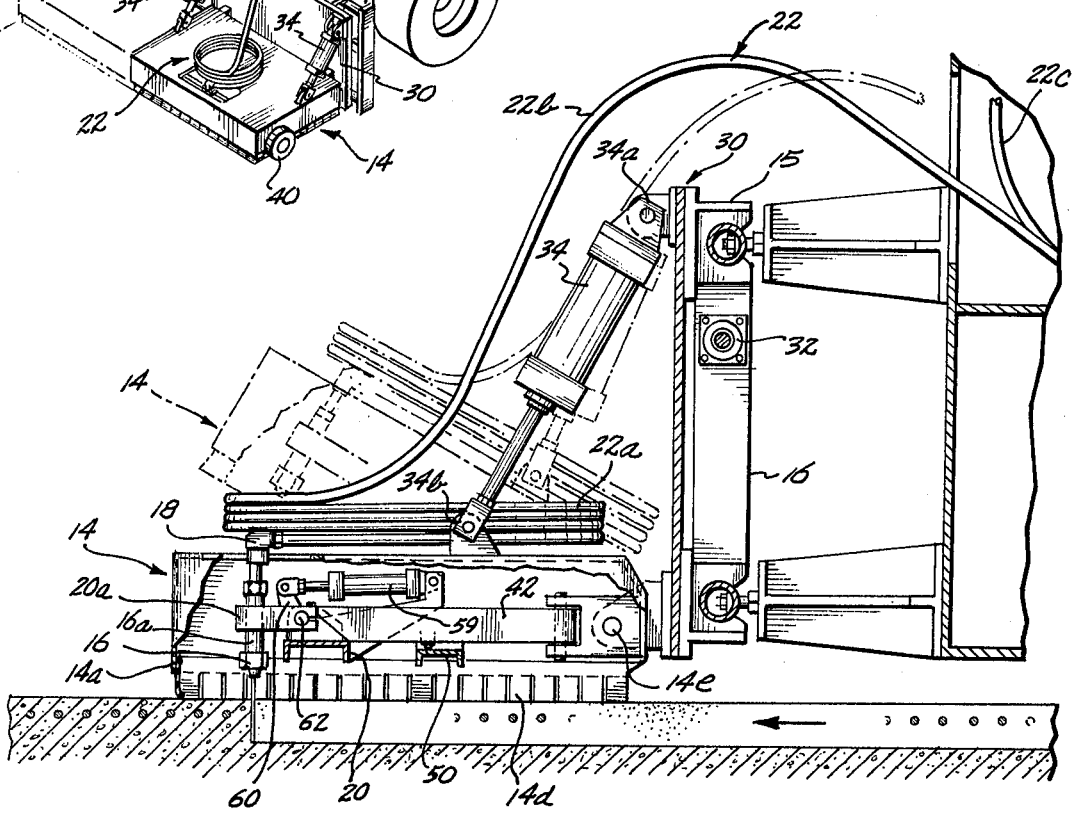
Fig. 2.

METHOD AND APPARATUS TO REMOVE STRUCTURAL CONCRETE

BACKGROUND OF INVENTION

This invention relates to improvements in methods and apparatus for removing hardened structural concrete from structures including steel-reinforced concrete structures. The invention is applicable, for example, in the repair of bridge spans and building structures by removing defective regions of concrete for replacements; also in the preparation of existing structures to make additions to them by removing old concrete in regions where joints are intended and also where reinforcing bars must be exposed for subsequent embedment in new concrete poured in constructing the addition. The invention is herein illustratively described by reference to its presently preferred embodiment and practice; however, it will be recognized that certain modifications and changes therein with respect to details may be made without departing from the essential features involved.

In the removal of hardened structural concrete from bridge spans and like structures it is, of course, highly important to avoid cutting into and damaging the reinforcing bars and also to avoid damaging the concrete in regions adjoining that to be removed. However, with the use of pneumatic jack hammers or similar tools, these requirements are difficult to satisfy in practice. The reinforcing bars, unpredictably located in most cases, are usually encountered by the jack hammer tool and perhaps damaged to some degree before the operator is aware of it. The clatter and vibration of a jack hammer accompanied by the accumulations of dust and concrete particles in the work area make it difficult for the operator to exercise very sensitive control over the cutting action on a continuing basis so as to avoid bar damage.

In addition, the repeated shocks of jack hammer blows can weaken the concrete in regions adjoining that initially designated for removal. This is especially the case in old structures wherein the concrete is brittle and often cracked by years of repeated load and thermal stress, the jack hammer blows often aggravating and extending such weaknesses. In addition, the repetition frequency of an air hammer tool can set up resonances in a concrete structure causing further damage. That such damage to adjoining concrete, involving enlarging and lengthening existing cracks and causing new ones, in serious in the conventional use of jack hammers has been determined by comparing results thereof with those achieved by the vibration-free technique of this invention. In general it is found that in like areas the actual amount of defective concrete that had to be removed with a jack hammer in order to pass inspection was considerably greater than that in the comparable case using the present invention. From these and other observations it is evident that use of a jack hammer type tool makes additional work for itself causing undesired job cost over-runs and often serious added damage to structures under repair. Yet jack hammers and other percussive tools, suffering these and other limitations and disadvantages, have still been regarded as essential heretofore for most jobs, especially the many where rotary cutters are impracticable.

With the foregoing and related considerations in view, a broad object of this invention is to provide an improved method and apparatus by which to remove volumes of hardened structural concrete over designated areas and to required depths both rapidly and efficiently, and to do so with precise removal dimensional control, without requiring an operator's constant close attention to tool action in the concrete, yet without causing incidental damage to the concrete in adjoining regions or to embedded reinforcing bars exposed in the removal process. With this invention the work area and the scanning jet nozzle system in action can be shielded for absorption of sound and shrouded for protective containment of loose particles and splashing water. Yet the resulting visual obscurement of the work area instantaneously involved presents no handicap or impediment to achieving the desired results.

A further object is to devise an improved technique for removing structural concrete, without the attendant problems of dust and noise pollution heretofore experienced; moreover, a process that is both efficient in terms of energy consumption per unit of work done, and relatively safe and less tiring and distasteful to attendant personnel.

Still another object hereof is to devise an improved apparatus and method to remove structural concrete safely and efficiently from around and beneath reinforcing bars and in the process thereof to scour the surfaces of the bars so as to remove corrosion and scale therefrom, preparing them for a better bond with new concrete, without cutting into and weakening the bar metal itself.

GENERAL SUMMARY OF INVENTION

In accordance with the invention, water is delivered under ultra-high pressures, i.e. in the range between substantially 25,000 psi and an upper value such as 60,000 psi, through narrowly restricted jet stream orifices directed against and scanned over the regions of structural concrete to be removed. By systematically scanning or otherwise covering the surface areas of such regions, by controlling or regulating the water pressures used and the water delivery rates achieved at those pressures, and by controlling the linear scanning rate employed, hence the dwell-time on each impact point traversed by the jets, the underlying concrete can be removed to desired depths with reliable accuracy. The removal occurs very rapidly and efficiently by comparison with prior methods and with the other advantages and conveniences described previously herein. Moreover, the removal action can be effected to any customarily required depth to and beyond reinforcing bars and without doing damage to those bars. In fact as previously indicated the surface condition of the bars for subsequent bonding to fresh concrete is significantly improved. By variably inclining the jets in relation to the incidence surface of the concrete the removal action can be enhanced in reaching to regions lying immediately beneath individual reinforcing bars and groups of such bars and any appertenances thereto.

In general terms the invention utilizes certain erosion and reaction forces of the jetted water streams attainable in the high pressure regime indicated. Such pressures are made possible, along with the attendant flow rates they produce in achieving high energy levels in the jets, by intensifiers such as disclosed in U.S. Pat. No. 3,811,795. For example, in a three-jet nozzle unit of this invention in which the three individual jet orifices are round and of 0.018 inch diameter, a 250 h.p. intensifier provides the desired power level in the working jets. At these high energy levels it is found that the hardened concrete aggregate pebbles are progressively exposed and lifted from their bonded embedment with literally explosive effect. This is evidently due to the rapid erosion of the grout material to subjacent regions between pebbles followed by abrupt reactive pressures driving the pebbles outwardly from their seats. In this manner, and by following a systematic pattern of scanning the jets over the area to be removed, preferably in repeated passes each deepening the cut by as much as ½ inch or more, depending on variables in the concrete material, pressures used, etc., the required total depth of removal is progressively accomplished very rapidly and with minimal expenditures of energy. Such progressive removal in depth may alternatively be accomplished by using a zig-zag area scan pattern repeated one or more times with one jet nozzle or widely spaced jet nozzles to cover an area, or by using a linear or other scan pattern with more closely spaced nozzles that can remove all of the material under and between adjacent nozzles efficiently to required depth in one or more passes. However, it is found that removal cannot be effected efficiently or rapidly to the deeper levels often required in just one pass of a single jet moved slowly across the material to effect the removal to intended depths in a narrow cut followed by others similarly formed. That procedure is slow and inefficient because of the impeding and restricting effects of the closely adjacent cut walls. These not only resist dislodgement of the larger pebbles in the concrete aggregate but limit their paths of dislodgement so severely as to interfere with the directness of action of the jet. It is thus important to the efficiency and rapidity of the removal process that lateral openness is created around the jet impact area at each new level of penetration before continuing to still deeper levels. This is not to say, of course, that the area or region removed cannot have sides formed by the adjoining remaining structure, because sides can be formed, without detriment with either alternative procedure mentioned above, namely repetitive scanning of a given area by one or more jets to make area-wide penetration by increments, or one-pass scanning of an area by parallel jets spaced closely enough to remove directly impacted and intervening material but far enough apart from ready escape of outwardly driven aggregate pieces without interferring with the jets.

The conditions and practices of the present invention are to be distinguished from the prior use of high pressure water jets to scour the surface of paving so as to clean it of adherent films, dirt, loose grout and sand and so as to roughen the surface to form a satisfactory bond with a new layer of concrete or asphaltic emulsion-aggregate paving. In such surface cleaning and scouring applications water pressures in the range not over 10,000 to 15,000 psi were employed and at those pressures the concrete material removed was limited to surface grout and occasional loose pebbles lying at the surface. The selection of a pressure range below the 15,000 psi precluded the scouring action from having any other significant effect on the concrete, and in particular precluded removal of structural concrete, i.e. defined herein as concrete including one or more levels or layers of aggregate bonded together in the matrix so as to present load bearing capability and to assume a load bearing function in the concrete structure acting as a beam, column, etc. Moreover with the present invention very small amounts of water are needed (e.g. 7½ gal. per min. with three nozzles) and the drainage water is relatively clear and unpolluted.

In terms of apparatus, the preferred embodiment disclosed includes a plurality of jet nozzles spaced apart in this case by such a distance as to require area wide scanning motion in order to remove material by levels or layers. The nozzles are mounted in parallel on a carriage that executes zig-zag scanning patterns, each contiguous to the next as the carriage advances. A shield at least partially enshrouding the nozzle assembly reduces emanations of noise, splashing water and expelled particles. The entire nozzle mechanism including shield can be raised and lowered and the nozzle assembly independently adjusted in height and nozzle inclination angle (to either side of a common nozzle plane perpendicular to the concrete area working surface) in order to reach more effectively regions beneath reinforcing bars and to accomodate the needs of special situations that may arise. In general, however, the nozzles may be set at a forward incline, that which directs the jets downwardly and with a horizontal component against the direction of progressive advance of the carriage. In this way maximum openness is afforded for escape of freshly dislodged pebbles. Alternatively the removal action in many cases is found to be just as efficient if not more so if the incremental depth removed in each area scan is kept small, with the nozzles inclined in the reverse direction relative to travel of the assembly.

These and other features, objects and advantages of the invention will become more fully evident from the following description thereof by reference to the accompanying drawings.

BRIEF DESCRIPTION OF DRAWINGS

FIG. 1 is a perspective view of a truck-mounted apparatus incorporating the invention for use on concrete bridge decks, aprons and highways.

FIG. 2 is an enlarged side elevation partly in section illustrating the apparatus shown in FIG. 1.

DETAILED DESCRIPTION OF DRAWINGS

Figure 3:
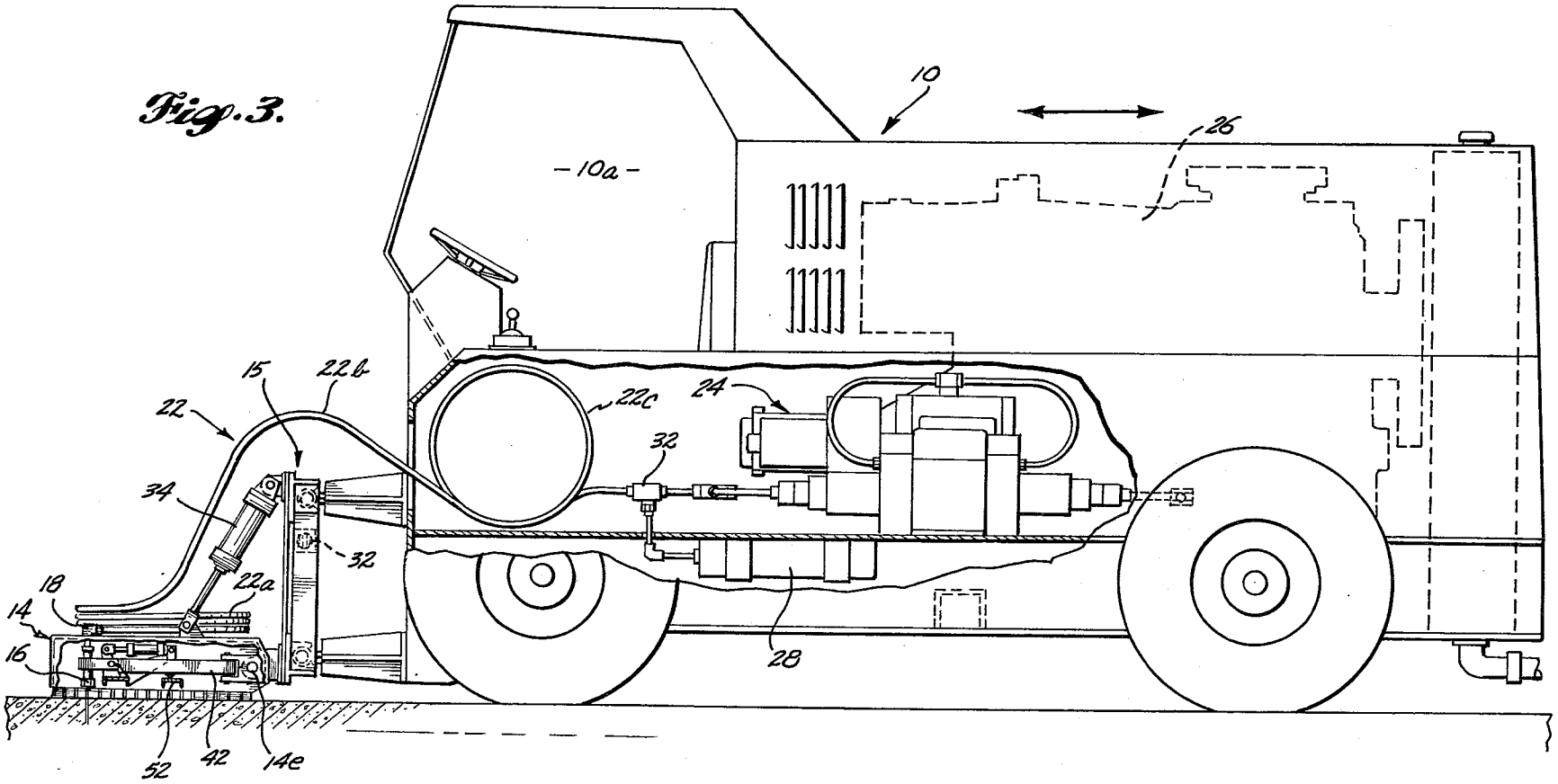
FIG. 3 is a side elevation of the truck-mounted system shown in FIG. 1 with parts broken away to reveal certain features of construction.
Figure 4:
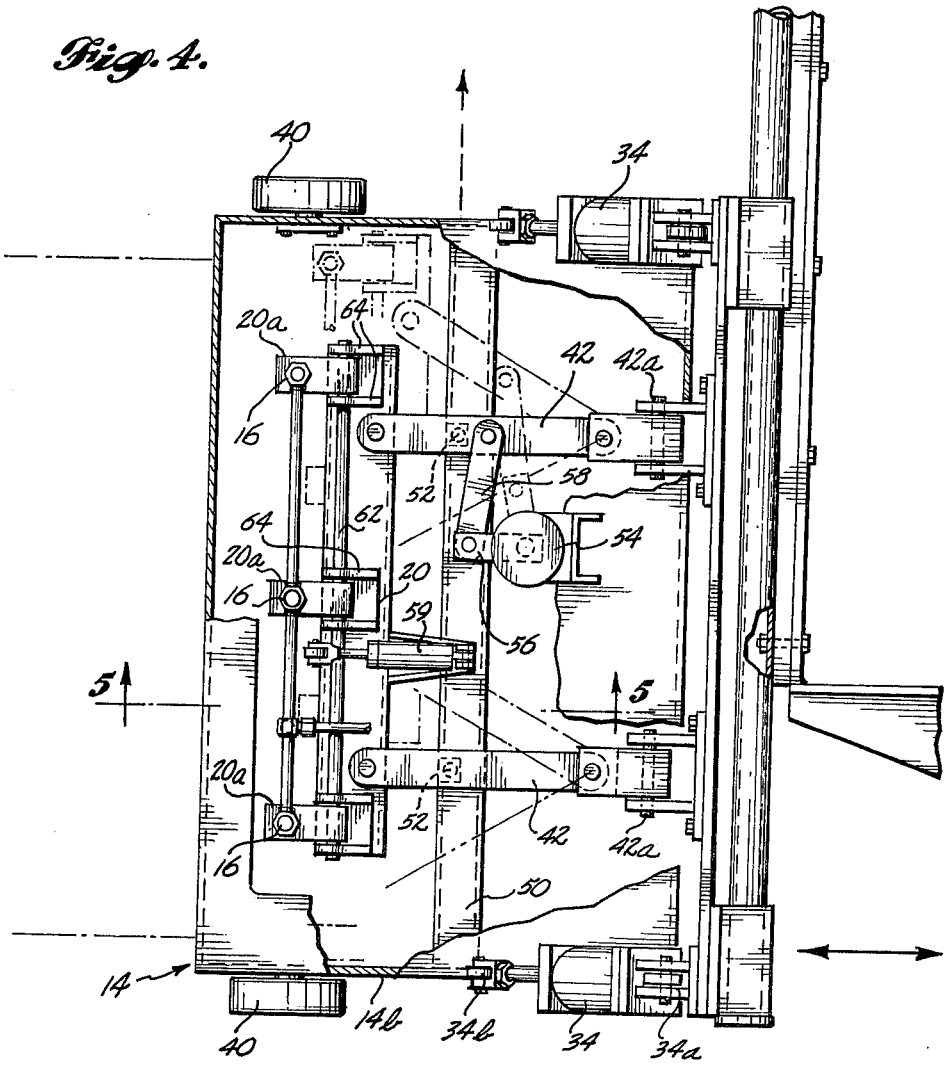
FIG. 4 is a plan view with parts broken away showing the apparatus depicted in FIG. 2.

Referred to the drawings, truck 10 rigged to tow a water-supply tank trailer 12, mounts the water jet nozzle mechanism 14 by means of a transversely disposed support frame 16. The frame extends across the forward lower portion of the truck adjacent the operator's cab 10*a*. In the example the apparatus 14 incorporates three high-intensity water jet collimating nozzles 16. These are mounted in parallel spaced relationship in a linear array extending in a horizontal line transverse to the longitudinal axis of the truck, hence at right angles to the line of travel shown by the arrow V. The nozzles are mounted on a support bar 20. Vertical adjustability of the nozzles in relation to the bar is permitted by any suitable means such as by threading the nozzle lead pipes **16*b* through tapped holes in the nozzle support blocks 20*a* that in turn are carried by bar 20** through a rocker shaft to be described.

Ultra-high pressure water is conducted to the nozzles through an overlying transverse header pipe 18 connected by way of a resiliently flexible metal tube 22 to an ultra-high water pressure source or pressure intensifier 24 mounted in the truck. In the example there are two such pressure intensifiers mounted on respectively opposite sides of the truck and each connected to be driven by an engine 26. One intensifier serves as a standby. A pressure accumulator 28 connected to the junction between the output of each intensifier 24 and the connecting tube 22 filters out pressure pulsations of the intensifier to provide a steady pressure to the supply tube 22. For purposes of this invention the pressure delivered to the nozzles is in the range between about 25,000 psi and 60,000 psi or higher. Moreover the flow/rates at which such pressure is maintained when structural concrete is to be removed at volumetric rates much higher than that possible with a jack hammer are such as to require a sizable power source to pump the water (e.g. 250 h.p. or more).

For use herein, U.S. Pat. No. 3,811,795 to Olsen discloses a suitable pressure intensifier, U.S. Pat. No. 3,905,608 to Olsen, an improved seal for use in such apparatus, patent application Ser. No. 657,180 filed Mar. 15, 1976 by Benjamin A. Thomas, an improved valve for use in such devices, and patent application Ser. No. 615,560 filed Sept. 22, 1975 by Benjamin A. Thomas and Edward W. Geller, liquid jet cutting techniques. The latter discloses a jet nozzle means for collimating liquid flow in a high pressure cutting jet of the type suitable for the nozzles 16 herein, together with a listing of prior art of interest relating to high pressure water jet cutting devices and applications thereof.

Nozzle assembly 14 including its associated actuating mechanism is supported on a base 30 mounted to slide longitudinally on the stationary frame 16. Its position transversely of the truck is established and changed by suitable means such as hydraulic or screw type actuator 32. In one extreme position shown by solid lines in FIG. 1 the nozzle unit 14 is located at one side of the vehicle and in its opposite extreme position shown by broken lines is at the opposite side of the vehicle. Thus the cutting action of the jet array may be applied in a swath adjacent either side of the path of travel of the truck and also at any intermediate location.

In order to withstand the extremely high pressures produced in the system high-pressure fittings and related design precautions must be employed throughout the system. Use of a resilient metal connecting pipe 22 instead of a hose represents a part of those precautions. The pipe is configured and arranged to flex in such manner as to accomodate not only transverse shifts of position of the nozzle unit 14 but also raising and lowering of that unit on its base hinge as hereinafter described. Such connecting pipe configuration starts adjacent the header 18 with a series of horizontal coils **22*a*. From these coils the tube 22 extends upwardly and aft of the truck through an upwardly arching bend 22*b* and thereafter through a single large vertical loop 22*c* to the fitting 32** at the junction between the intensifier output and the accumulator.

Raising and lowering the nozzle unit 14 on its base hinges **14*e* is effected by means including a pair of hydraulic jacks 34 extending from respective connecting lugs 34*a* at the upper side edges of the base 30 and lugs 34*b* on the upper side edges of the nozzle unit housing cowling 14*a*, as shown in FIGS. 1 and 2. In its lowered position the cowling 14*a* generally overlies and surrounds the nozzle array and its supporting and scanning mechanism; also the general work area overlying and surrounding the surface area of the underlying concrete under impingement by the water jets. Height of cowling in its lowered, operating position is established at the desired level in relation to the paving surface by means of wheels 40** located at respectively opposite sides of the cowling. A flexible skirting depending from the lower edge of the cowling around its perimeter accomodates surface roughness and pieces of material as the unit advances while helping to shield surrounding areas from splashing water and flying debris.

Figure 9:
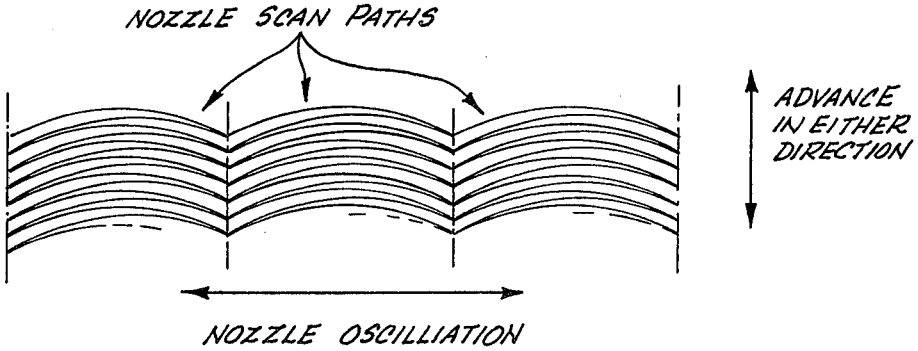
FIG. 9 illustrates a preferred scanning pattern produced by oscillation of the nozzle array during progressive advance of the device over concrete to be removed.
Figure 8:
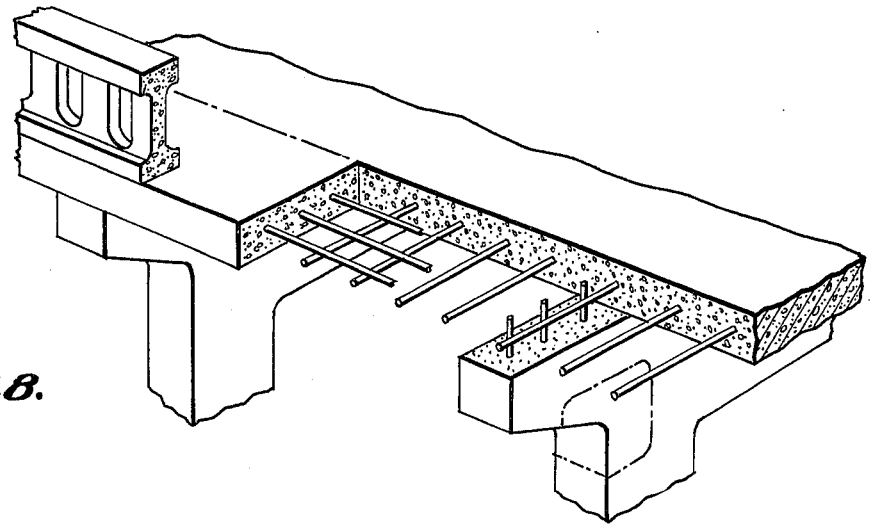
FIG. 8 is a fragmentary perspective view of a typical bridge deck and associated structure with parts broken away and with part of the structural concrete in the deck having been cut away by use of the invention to expose reinforcing bars in preparation for repouring the concrete or making an addition to the existing structure.

In order to produce the illustrated nozzle array scanning pattern depicted in FIG. 9 during advancement of the truck progressively in a selected path over the concrete surface to be removed by the nozzle jet action, the nozzle support bar 20 is mounted for longitudinal reciprocation as an element of a parallelogram linkage including the parallel bar support arms 34 and the nozzle unit base 30 to which the arms 42 are joined by means of hinges **42*a* pivotally coaxial with housing unit support hinges 14*e*. The weight of arms 42 and the nozzle array assembly carried by these arms is borne by an underlying channel 50 extending transversely across the nozzle unit housing. Nozzle array reciprocation is effected by a motor 54 turning a crank 56 connected by a link 58 to one of the arms 42 as shown. Anti-friction bearing elements 52 mounted in the lower surfaces of arms 42 riding on a bearing surface provided by support channel 50 reduces the load on reciprocation drive motor 54** and frictional wear of the parts.

Figure 5:
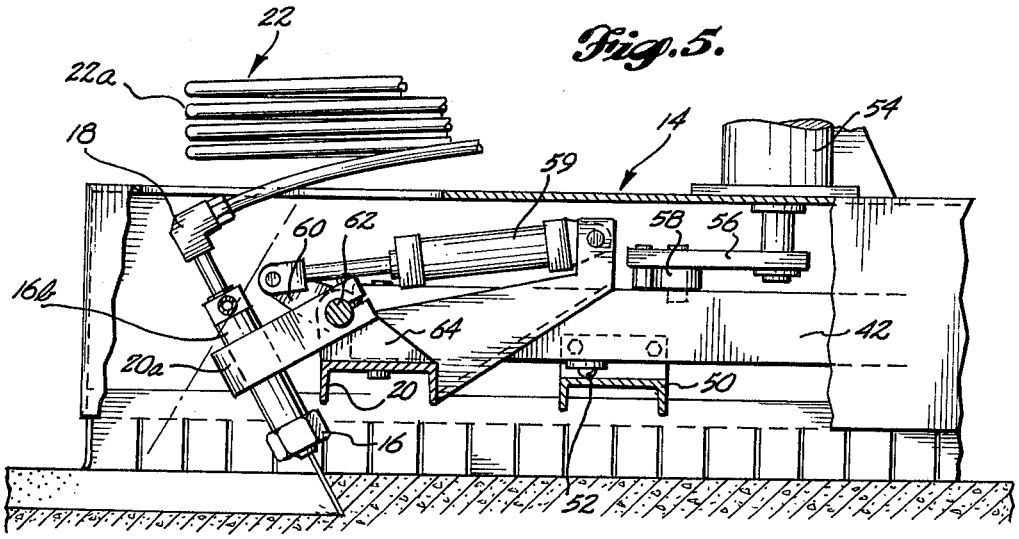
FIG. 5 is an elevational section taken on line 5—5 in FIG. 4.
Figure 6:
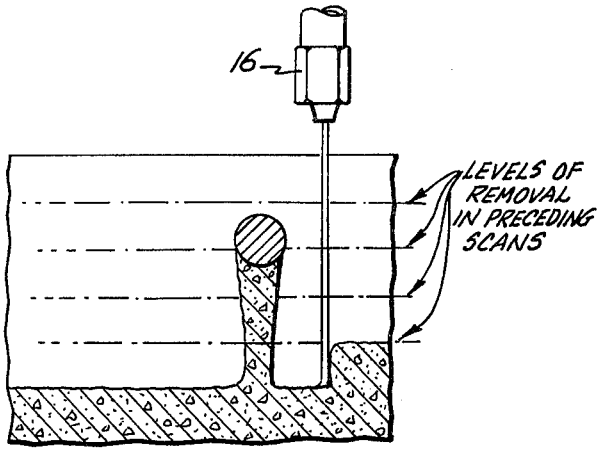
FIG. 6 is an operating elevational section showing the cutting action of a vertically oriented nozzle working in steel reinforced concrete.
Figure 7:
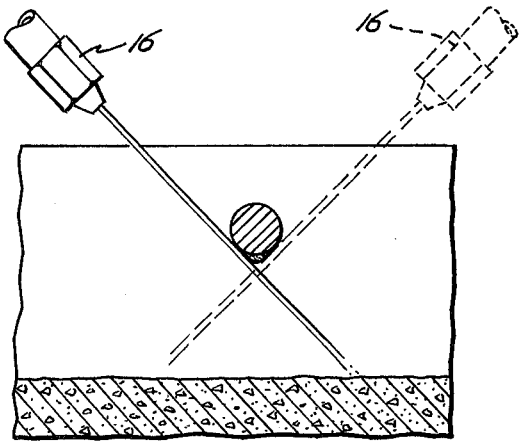
FIG. 7 is a view similar to FIG. 6 illustrating the effect of nozzle tilting.

The array of nozzles 16 is mounted so that the nozzle axes can be tilted out of their normal vertical position through a range of angles of inclination, both forward and rearward in relation to the line of advance of the truck (see FIG. 7). In FIG. 5, for example, the nozzles are inclined forwardly. This tilting control lends an added degree of flexibility to the concrete removal capability of the nozzle jets as previously explained.

In order for the operator to be able to tilt the nozzle array by controls operated from within the truck cab; the support bar 20 mounted on arms 42 carries one end of hydraulic jack 59. The jack's opposite end is connected to a crank arm 60 rigidly mounted on an elongated rocker shaft 62 to which the nozzle mounting blocks **20*a* are secured. Shaft 62 in turn is journalled to revolve in support lugs 64 carried by support bar 20. Operator controlled extension and contraction of the hydraulic jack 58 thus varies the tilt angle of the nozzles 16** through the desired range of nozzle inclination in the longitudinal vertical plane of travel of the mechanism.

In operation with the nozzle array unit 14 appropriately located on support frame 15 transversely of the truck through use of the positioning jack 32, the scanning motor 54 is started in order to oscillate the nozzle array horizontally in a direction transverse to the line of advance of the truck. The throw of crank arm 56 is so selected that the individual nozzles reciprocate through the scan stroke that causes the jet of each nozzle to cut away a region of concrete contiguous to but not overlapping that cut by the adjacent nozzle in executing its scan stroke (FIG. 9). The vehicle is operated at such a speed of advance that the cutting and removal action of each jet on each successive scan stroke is contiguous to that of the last preceding stroke, with or without some overlapping effect. Pressure of water delivered by the intensifiers 24 is selected at a desired value within the range previously indicated so as to achieve the desired removal action. Since the characteristics of the concrete vary from job to job the operator can vary the parameters of water pressure, nozzle height and incline, nozzle scan speed and speed of advance of the scanning array to suit his preference or the requirements of each job.

These and other aspects of the invention will be apparent from the foregoing description including that of the presently preferred and illustrative embodiment.

What is claimed is:

1. The method of removing from a concrete structure an area of structural concrete extending inwardly through levels of aggregate to predetermined depth, comprising directing against the concrete water jetted to impinge the same under pressure in the range above substantially 25,000 pounds per square inch in at least one or more separate impinging streams having an energy level created by such pressure sufficient to erode and remove the concrete to such depth, each such stream having a lesser cross-sectional width in any direction than the width of such area measured in said direction, progressively advancing each impinging stream across said area in concrete in a line of motion that removes the structural concrete impinged thereby first to a partial depth a minor fraction of said predetermined depth and thereafter to said predetermined depth preceded by removal of adjacent structural concrete substantially to said partial depth by such jetted water impinging the concrete adjacent to said line, whereby continued depth penetration and removal of said layers of aggregate at one location in said area is substantially paced by penetration and removal in adjoining locations so as to maintain openness around any such locations for escape of aggregate particles without substantially impeding the directness of such jetted water impingement on the concrete.

2. The method defined in claim 1 wherein each jetted water stream is scanned progressively over one concrete area in repeated passes respectively removing the concrete by successive incremental fractions of said predetermined depth.

3. The method defined in claim 1 wherein the concrete to be removed incorporates reinforcing bars exposed, impinged upon and scoured by the concrete removal action of the jetted water.

4. The method defined in claim 3 wherein the angle of incidence of the water jetted against the area of concrete to be removed is varied during such removal.

5. The method defined in claim 1 utilizing a plurality of such jets spaced apart in a linear array advanced progressively across said area in a direction perpendicular to the line of the array while reciprocating the array lengthwise of itself so as to scan the area in mutually adjoining zig-zag patterns.

6. The method defined in claim 5 wherein the concrete to be removed incorporates reinforcing bars exposed, impinged upon and scoured by the concrete removal action of the jetted water.

7. The method defined in claim 6 wherein the angle of incidence of the water jetted against the area of concrete to be removed is varied during such removal.

8. The method defined in claim 5 wherein such progressive scan over the area of concrete is repeated at least once, whereby removal of the concrete to said predetermined depth is effected by depth increments.

9. The method defined in claim 8 wherein the concrete to be removed incorporates reinforcing bars exposed, impinging upon and scoured by the concrete removal action of the jetted water.

10. The method defined in claim 9 wherein the angle of incidence of the water jetted against the area of concrete to be removed is varied during such removal.

11. Apparatus for removing from a concrete structure an area of structural concrete extending from the surface thereof inwardly through levels of aggregate to predetermined depth, comprising a source of water operable to deliver water under steady pressure exceeding substantially 25,000 psi, nozzle means receivingly connected to said source and operable to jet the water under such steady pressure against the concrete in one or more steady impinging streams with an energy level created by such pressure sufficient to cut and remove the concrete by eroding it away to such depth, carriage means supporting and directing said nozzle means against the concrete and operable to effect progressive movement of the nozzle means in a manner systematically to scan said area by such jetted water impingement at a controlled rate and to repeat such scan so as to erode the concrete to successively increased depths over such area.

12. The apparatus defined in claim 11 wherein the nozzle means comprises a linear array of successively spaced nozzles mounted in substantially parallel relationship on the carriage means.

13. The apparatus defined in claim 12 operable to progressively advance the nozzles in a direction perpendicular of the line of the array while reciprocating the array lengthwise of itself in a plane substantially parallel to the surface of the concrete area to be removed.

14. The apparatus defined in claim 13 further including positioning means operable to vary the angular direction of the nozzles in the carriage means in their respective planes perpendicular to the line of the array.

15. The apparatus defined in claim 14 wherein the range of angular positions includes an intermediate position directing the nozzles at right angles to the concrete surface and extends to inclined angular positions on either side of said intermediate position.

16. The apparatus defined in claim 15 wherein the carriage means further includes shield means at least partially surrounding and enclosing the array of nozzles and the surface space above the concrete under impingement by water jetted from such nozzles, thereby to absorb sound and contain splashing water and flying concrete particles being ejected by force of the water.

17. The apparatus defined in claim 12 wherein the carriage means further includes shield means at least partially surrounding and enclosing the array of nozzles and the surface space above the concrete under impingement by water jetted from such nozzles, thereby to absorb sound and contain splashing water and flying concrete particles being ejected by force of the water.

* * * * *